US005460295A

United States Patent [19]

Law

[11] Patent Number: 5,460,295

[45] Date of Patent: Oct. 24, 1995

[54] CANDY DISPENSING SYSTEM

[75] Inventor: Herbert C. Law, Hunghom, Hong Kong

[73] Assignee: Pez Candy Inc., Orange, Conn.

[21] Appl. No.: 262,885

[22] Filed: Jun. 21, 1994

[51] Int. Cl.[6] ..... B65H 1/12

[52] U.S. Cl. ..... 221/185; 221/198; 221/199; 221/226; 221/270; 221/274

[58] Field of Search ..... 221/185, 198, 221/199, 226, 268, 270, 274, 279

[56] References Cited

U.S. PATENT DOCUMENTS

| | | | |
|---|---|---|---|
| 2,347,823 | 5/1944 | Goodman et al. | 221/185 X |
| 2,591,855 | 4/1952 | Nicholson | 221/270 X |
| 3,344,951 | 10/1967 | Gervais | 221/198 X |
| 4,295,579 | 10/1981 | Haas | 221/198 X |
| 4,427,130 | 1/1984 | Szigeti | 221/185 X |
| 4,530,445 | 7/1985 | Decker | 221/198 |
| 4,589,575 | 5/1986 | Rigberg et al. | 221/198 |
| 5,071,033 | 12/1991 | Siwek | 221/270 X |

*Primary Examiner*—William E. Terrell
*Assistant Examiner*—Dean A. Reichard
*Attorney, Agent, or Firm*—Burns, Doane, Swecker & Mathis

[57] ABSTRACT

A candy dispensing system is provided comprising a housing in which is defined a chamber for receiving a plurality of candies. The chamber has a dispensing opening and an arm for urging candies in the chamber so that one candy is always located adjacent the dispensing opening. A second arm and a push rod are provided for dispensing candies through the dispensing opening. In one embodiment such a candy dispensing apparatus may be combined as part of a children's wrist watch.

2 Claims, 2 Drawing Sheets

CANDY DISPENSING SYSTEM

FIELD OF THE INVENTION

This invention relates to apparatus for storing candies and sweets and for dispensing such candies one at a time upon demand by a user. The invention also relates to a novelty item incorporating the candy dispenser.

BACKGROUND OF THE INVENTION

Candies and sweets are immensely popular with children. Conventionally candies are purchased packaged in a wide variety of forms. For example they may come in a small plastic bag, in a cardboard tube or otherwise wrapped in paper or plastic. Such packagings for candies are invariably disposable and often lead to a problem with litter, especially since children are often not very conscientious about disposing of litter properly.

Furthermore traditional packagings for candies do not have a "fun" element associated with them. In some cases, especially small sealed plastic bags, they can be difficult to open causing frustration in a child.

SUMMARY OF THE INVENTION

It is an object of the present invention therefore to provide a candy delivery system that is not disposable after just one use but which can be reused, which is simple to use, and which provides an element of fun to a child.

According to the present invention therefore there is provided a candy dispensing apparatus comprising, a chamber for receiving a plurality of candies, said chamber having a dispensing opening, means for urging candies received in said chamber whereby in use one candy is located in a dispensing position adjacent said dispensing opening, and means operable by a user for dispensing a candy from said dispensing position through said dispensing opening.

Preferably the dispensing means comprises a push rod adapted to push a candy located at the said dispensing position through said dispensing opening. The dispensing position may be located at one end of said chamber and said urging means may comprise a spring-biassed arm that acts upon said candies to urge then from the end of said chamber remote from the dispensing opening toward said opening.

The candy dispensing push rod may also be spring-biassed away from the dispensing position. In use the push rod may be operated by a user so as to move against such a spring-bias and upon release by a user after the dispensing of a candy the push rod will return under the spring bias to a non-operative position.

Preferably the urging arm may be pivotally mounted to an axis, and further the push rod may be connected itself to a second arm pivotally mounted to the same axis. Both arms may be spring-biassed by means of a spring provided on said axis.

Preferably the dispensing apparatus comprises a housing divided into two substantially equal halves, one half defining the candy receiving chamber and the pivot axis, urging arm, second arm and push rod all being located in the other half, save for a portion of the urging arm which extends into the receiving chamber to act upon candies received therein. Such an arrangement is particularly convenient since it is compact and provides a high proportion of space for the candy receiving chamber.

The candy dispensing apparatus described above is simple and convenient to use and provides a certain element of fun to a child. However this from element can be maximised if the dispensing apparatus were to be incorporated into another item, for example a wrist watch.

Therefore according to another aspect of the present invention there is provided a wrist watch comprising a housing provided with a watch assembly, said housing defining therein a chamber for receiving a plurality of candies, said chamber having a dispensing opening, means for urging candies received in said chamber whereby in use one candy is located at a dispensing position adjacent said dispensing opening, and means operable by a user for dispensing a candy from said dispensing position through said dispensing opening.

Such a combined watch and candy dispenser will provide a child with additional amusement and entertainment.

BRIEF DESCRIPTION OF THE DRAWINGS

An embodiment of the invention will now be described by way of example and with reference to the accompanying drawings, in which.

DETAILED DESCRIPTION OF PREFERRED EMBODIMENT

Figure 1:
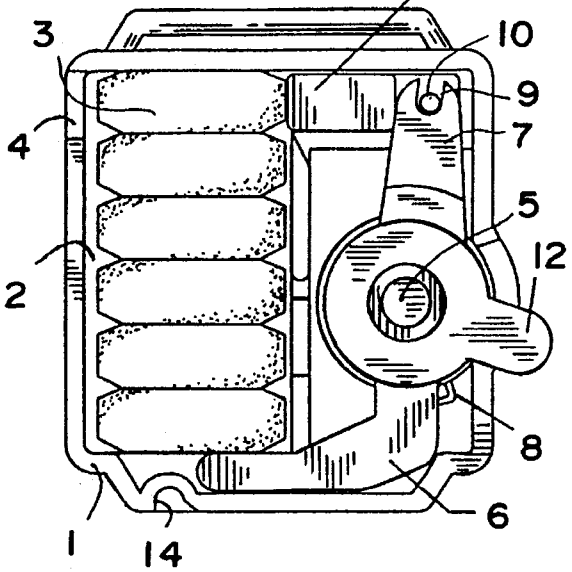
FIGS. 1–4 are sectional plan views showing in succession the operation of a first embodiment of the invention.

Referring firstly to FIGS. 1–4 there is shown therein a candy dispenser having an upper cover removed so that the internal mechanism can be seen. The dispenser comprises a generally square housing 1. One half of the housing defines a candy receiving chamber 2 which in this embodiment is large enough to hold up to six pieces of candy 3. At one end the receiving chamber 2 is provided with a dispensing opening 4 dimensioned to allow one piece of candy to be dispensed. The end of the receiving chamber 2 adjacent the dispensing opening may be regarded as a dispensing position.

The remaining half of the housing 1 is provided with a pivot axis 5 to which are rotatably mounted a first L-shaped arm 6 and a second arm 7. Both arms 6,7 are spring-biassed by spring means 8 fixed to said pivot axis 5 so as to be biassed to rotate in a clockwise direction as viewed in the Figures.

The first L-shaped arm 6 has a distal end which extends into the candy receiving chamber at an end remote from the dispensing opening 4 and which contacts pieces of candy received within the chamber 2. Because of the spring bias applied to the arm 6 the effect is that the distal end of the arm 6 urges the pieces of candy upwardly as viewed in the Figures toward the candy dispensing position adjacent the dispensing opening.

The second arm 7 is provided at its end remote from the pivot axis 5 with a slot 9 which engages a corresponding pin 10 provided on the end of a push rod 11. The push rod 11 is constrained for lateral movement between the side wall of the housing 1 and an internal wall so as to act upon a piece of candy at the dispensing position. The second and 7 is also provided with an operating lever 12 which allows arm 7 to be rotated in a direction opposite to its spring bias.

Figure 2:
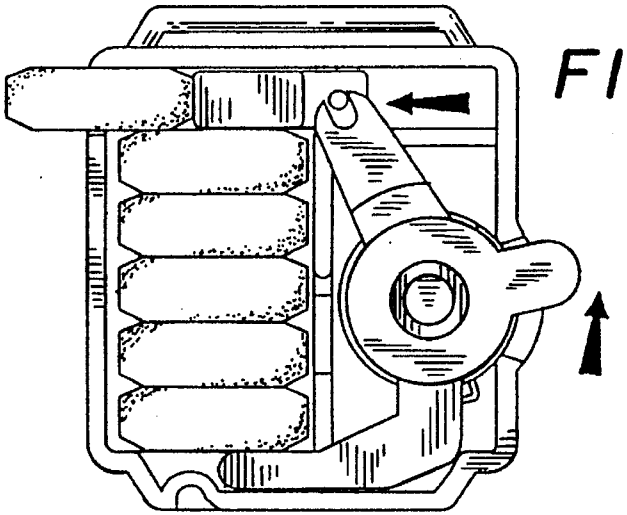
Figure 3:
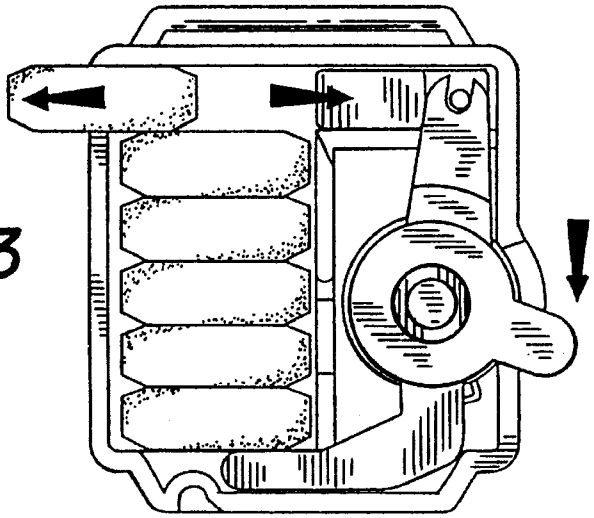
Figure 4:
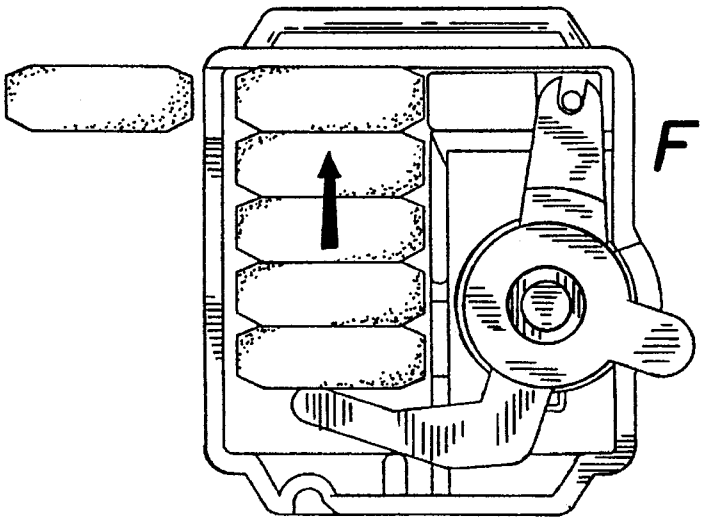

Operation of the candy dispensing apparatus will now be described with reference to FIGS. 1–4. Upon movement of the operating lever 12 in an anti-clockwise sense as shown in FIG. 2 the second arm 7 is caused to rotate in an anti-clockwise sense opposite to its spring bias. Through the action of slot 9 and pin 10 this causes push rod 11 to move to the left and to push a piece of candy 3 out through the dispensing opening 4. Upon release of the operating lever 12 the spring bias causes lever 12 and the push rod 11 to return to their original positions as shown in FIG. 3. At this stage the first arm 6 acting through the pieces of candy 3 urges the next piece of candy into the dispensing position adjacent the opening 4 ready for the next dispensing operation.

Although not shown in FIGS. 1–4 the housing is provided with a cover. The cover is also fitted to the pivot axis 5 and may be rotated through 180° in order to open the housing 1 to allow the housing to be filled with pieces of candy. The under surface of the cover is provided with a locking pin which engages a corresponding receiving notch 14 formed in the wall of the housing in order to lock the housing closed.

Figure 5:
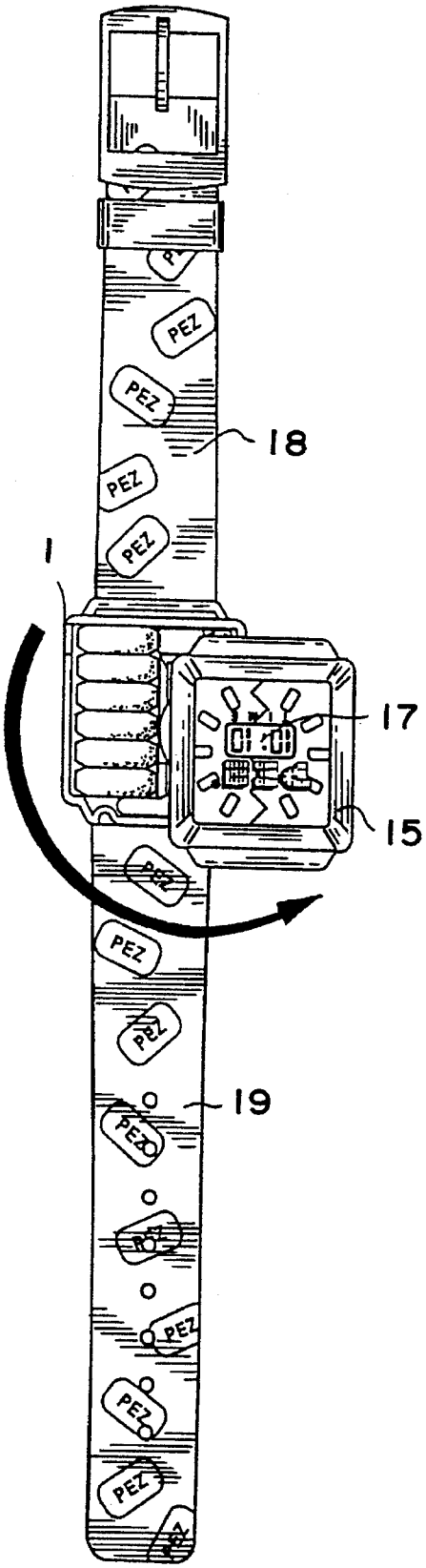
FIG. 5 is a plan view of a wrist watch incorporating the dispensing apparatus of FIGS. 1–4.
Figure 6:
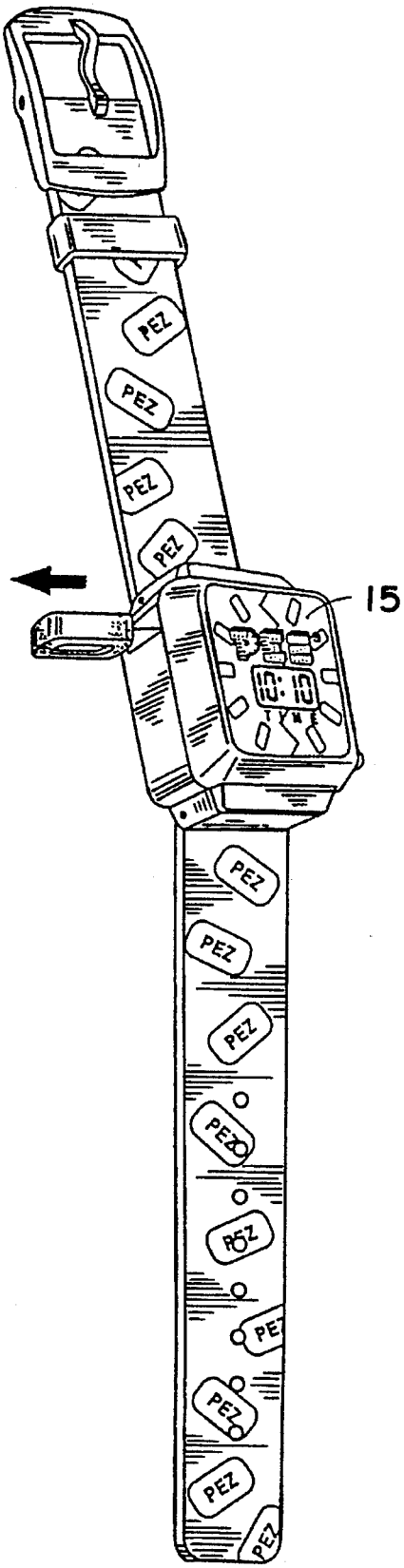
FIG. 6 is a perspective view of a wrist watch incorporating the dispensing apparatus of FIGS. 1–4.

The candy dispensing apparatus of FIGS. 1–4 may be incorporated into a wristwatch as shown in FIGS. 5 & 6. The upper cover 15 of the housing is formed with a digital watch assembly 17 and watch straps 18,19 are attached to the ends of the housing 1. FIG. 5 shows such a watch with the top cover 15 rotated to open the housing as discussed above. FIG. 6 shows the watch in perspective with a piece of candy being dispensed. It will also be understood that the dispensing apparatus could also be incorporated into many other products, for example into items of jewelry for children.

I claim:

1. Candy dispensing apparatus comprising: a chamber for receiving a plurality of candies, said chamber having a dispensing opening, an arm pivotally mounted to a pivot axis for urging candies received in said chamber whereby in use one candy is located in a dispensing position adjacent said dispensing opening, and a push rod operatively connected to said pivot axis by a second arm whereby rotation of said second arm about said axis causes lateral movement of said push rod for dispensing a candy from said dispensing position through said dispensing opening.

2. Candy dispensing apparatus as claimed in claim 1 comprising a housing divided into two substantially equal halves, one half defining the candy receiving chamber, and the pivot axis, urging means, second arm and push rod all being located in the other half.

* * * * *